United States Patent [19]

Wilcox et al.

[11] 4,202,236

[45] May 13, 1980

[54] CHORD PATTERN GENERATOR

[75] Inventors: Brian N. Wilcox; John W. Robinson, both of Jasper, Ind.

[73] Assignee: Kimball International, Inc., Jasper, Ind.

[21] Appl. No.: 904,741

[22] Filed: May 11, 1978

[51] Int. Cl.[2] ..... G10H 1/02; G10H 5/06

[52] U.S. Cl. ..... 84/1.03; 84/1.26; 84/DIG. 12; 84/DIG. 22

[58] Field of Search ..... 84/1.01, 1.03, 1.17, 84/1.24, 1.26, DIG. 4, DIG. 22, DIG. 8, DIG. 11, DIG. 12

[56] References Cited

U.S. PATENT DOCUMENTS

| | | | |
|---|---|---|---|
| Re. 29,144 | 3/1977 | Bunger | 84/1.03 |
| 3,389,211 | 6/1968 | Slaats | 84/1.26 |
| 3,706,837 | 12/1972 | Arsem | 84/1.17 |
| 3,715,442 | 2/1973 | Freeman | 84/DIG. 22 |
| 3,854,366 | 12/1975 | Deutsch | 84/1.03 |
| 4,010,667 | 3/1977 | Kniepkamp | 84/1.24 |
| 4,054,078 | 10/1977 | Kondo | 84/1.03 |
| 4,117,758 | 10/1978 | Osburn | 84/1.01 |
| 4,117,759 | 10/1978 | Kato | 84/1.01 |
| 4,120,225 | 10/1978 | Dietrich | 84/DIG. 22 |
| 4,156,379 | 5/1979 | Studer | 84/1.03 |
| 4,162,644 | 7/1979 | Sakashita | 84/1.03 |

*Primary Examiner*—J. V. Truhe
*Assistant Examiner*—William L. Feeney
*Attorney, Agent, or Firm*—Albert L. Jeffers; John F. Hoffman

[57] ABSTRACT

Circuitry for generating rhythmic patterns of notes corresponding to notes of a selected chord wherein tone signals according to the notes of the selected chord are connected to the inputs of keyers each time a chord playing key is depressed and control a current which flows through the keyers to the organ output circuitry in accordance with a selected pattern sequence of notes which is provided to a plurality of envelope generators at a rhythmic rate. The keyers are grouped to correspond to the four components of a selected chord and each of the keyer groups has an individual envelope generator connected thereto which activates the keyer group under the command of the selected pattern and imparts a characteristic attack and decay envelope to the tone signal.

13 Claims, 6 Drawing Figures

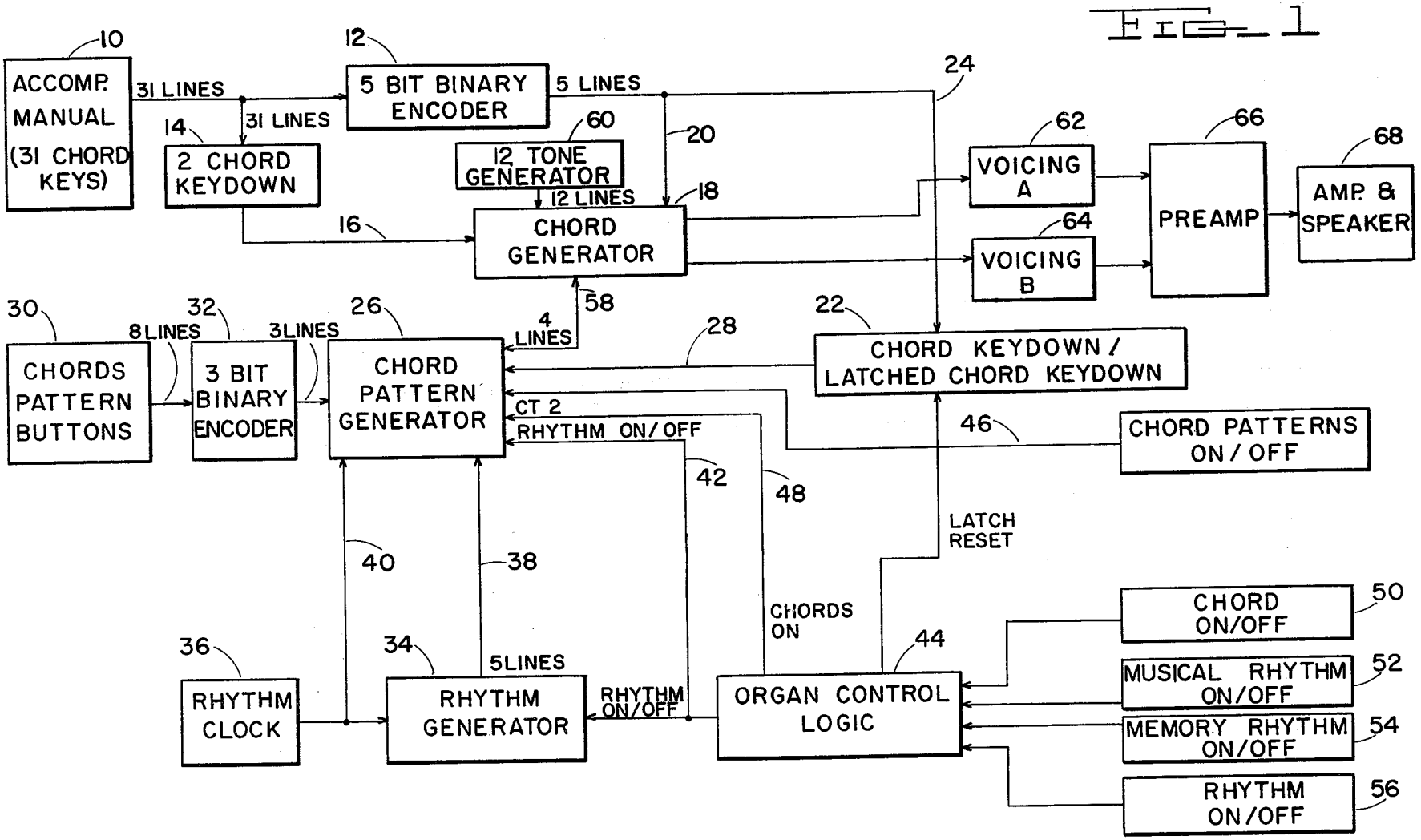
FIG. 1
ACCOMP. MANUAL (31 CHORD KEYS)
10
31 LINES
2 CHORD KEYDOWN
14
31 LINES
5 BIT BINARY ENCODER
12
5 LINES
12 TONE GENERATOR
60
12 LINES
CHORD GENERATOR
58
20
18
24
16
VOICING A
62
VOICING B
64
PREAMP
66
AMP. & SPEAKER
68
CHORDS PATTERN BUTTONS
30
8 LINES
3 BIT BINARY ENCODER
32
3 LINES
CHORD PATTERN GENERATOR
26
4 LINES
CHORD KEYDOWN / LATCHED CHORD KEYDOWN
22
28
CT 2
RHYTHM ON/OFF
CHORD PATTERNS ON/OFF
46
LATCH RESET
48
CHORDS ON
42
38
40
RHYTHM GENERATOR
34
5 LINES
RHYTHM ON/OFF
RHYTHM CLOCK
36
ORGAN CONTROL LOGIC
44
CHORD ON/OFF
50
MUSICAL RHYTHM ON/OFF
52
MEMORY RHYTHM ON/OFF
54
RHYTHM ON/OFF
56

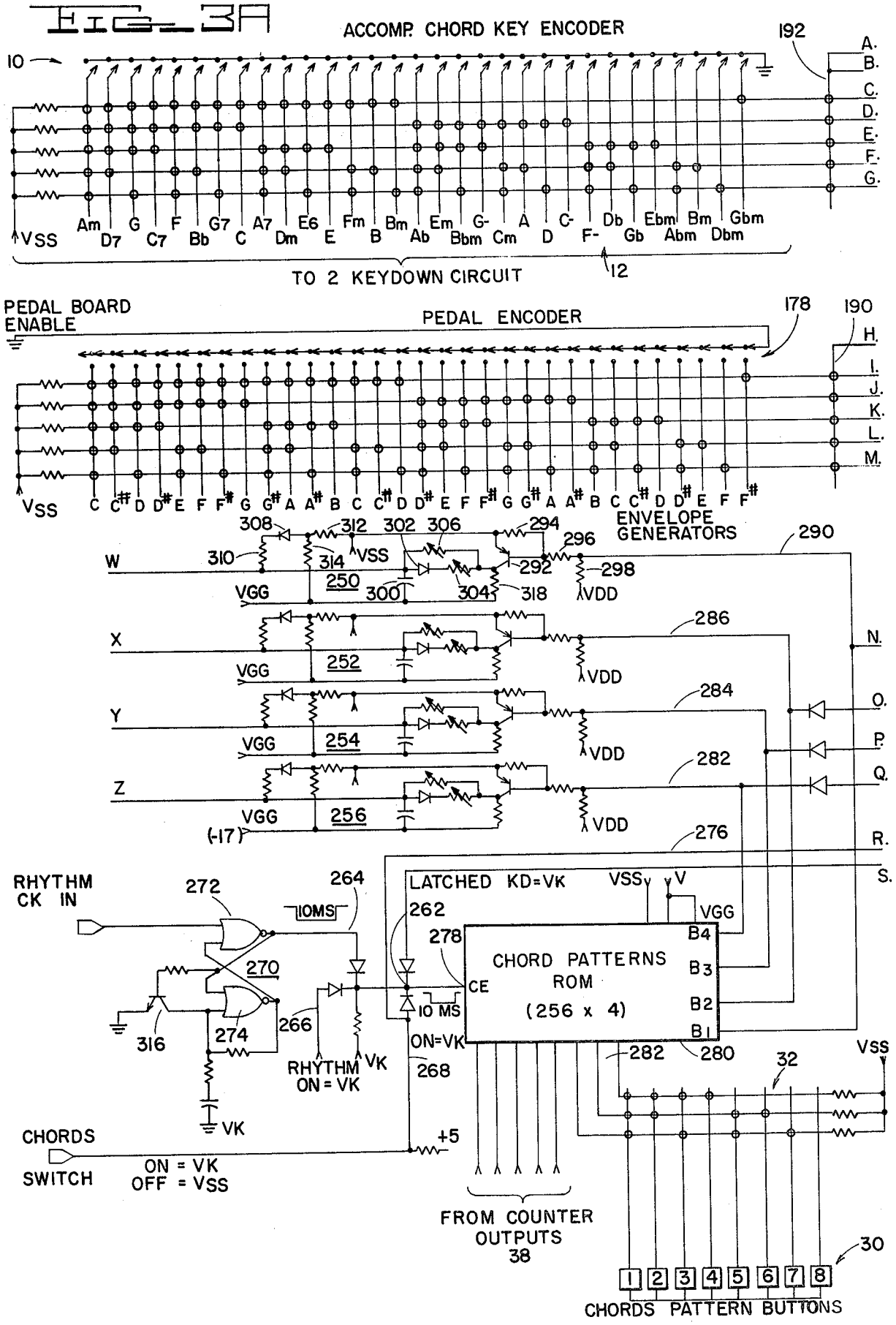
FIG. 3A
ACCOMP. CHORD KEY ENCODER
192
10
A.
B.
C.
D.
E.
F.
G.
VSS
Am D7 G C7 F Bb G7 C A7 Dm E6 E Fm B Bm Ab Em Bbm G- Cm A D C- F- Db Gb Ebm Abm Bm Dbm Gbm
TO 2 KEYDOWN CIRCUIT
12
PEDAL BOARD ENABLE
PEDAL ENCODER
178
190
H.
I.
J.
K.
L.
M.
VSS
C C# D D# E F F# G G# A A# B C C# D D# E F F# G G# A A# B C C# D D# E F F#
ENVELOPE GENERATORS
290
W
X
Y
Z
VGG
VDD
250
252
254
256
(-17)
286
284
282
276
N.
O.
P.
Q.
R.
S.
RHYTHM CK IN
272
264
10MS
270
274
266
316
VK
RHYTHM ON = VK
LATCHED KD=VK
VSS
V
VGG
262
278
CHORD PATTERNS ROM (256 x 4)
CE
10 MS
ON=VK
268
B4
B3
B2
B1
280
32
CHORDS SWITCH
ON = VK
OFF = VSS
+5
FROM COUNTER OUTPUTS 38
30
1 2 3 4 5 6 7 8
CHORDS PATTERN BUTTONS QXXY
LFO
110
108
106
LATCH UPDATE DEBOUNCE
112
2 KD
UPDATE
LATCHED
104
M
N
P
Q
R
5 BIT INPUT LATCH
10 X 32 DECODER ROM (220 BITS)
20
102
CHORDS ON
CT2
124
$\phi_1$
CONTROL GEN
122
A.
B.
C.
114
31 LINES
TONE 1 ROM 21 X 12 (372 BITS)
12 LINES
116
TONE 2 ROM 21 X 12 (372 BITS)
118
TONE 3 ROM 21 X 12 (372 BITS)
120
TONE 4 ROM 21 X 12 (372 BITS)
134
132
130
128
146
138
140
142
144
÷2
2'
4'
8'
D.
E
F.
148
OCTAVE ROM 31 X 4 (124 BITS)
12 TONES IN
TOP OCTAVE
126
G.
H.
I.
J.
K.
L.
C B A# A G# G F# F E D# D C#

CHORD PATTERN GENERATOR

BACKGROUND OF THE INVENTION

The invention relates to means for producing a rhythmic pattern of tones in an electronic organ, and in particular to means for generating such a pattern wherein the tones correspond to notes of a selected chord.

With recent developments in digital circuitry for organs and the advent of easy play features, it has become common practice to provide circuitry whereby patterns of notes are produced from memories and then automatically played by the organ with minimal effort on the part of the person playing the organ. In one configuration, chords are treated by analog methods to produce various combinations and sequences of sounds and in other configurations, digital techniques have been employed to produce the sequence of notes, one note at a time in a monophonic system. In other digital configurations, a plurality of notes are sounded together but the individual notes in each chord have not been treated in an individual, independent manner. In those instances where individual notes of the selected chord are treated in a digital manner, it has been with the two level on/off type keying inherent in those methods.

A drawback to many prior art systems wherein patterns of notes are generated automatically, is the relative complexity of the circuitry necessary to accomplish this result. Furthermore, it was often necessary to tailor the circuitry of the entire organ to accommodate this feature and it could not, therefore, be easily incorporated into existing organ circuitry.

SUMMARY OF THE INVENTION

In the present invention, analog envelope wave forms are generated by digitally produced input pulses to alter digitally derived tones so as to impart thereto predetermined attack and decay characteristics. A plurality of tones corresponding respectively to the notes of a selected chord are provided to the inputs of a plurality of keyer groups each time chord producing means on the keyboard are depressed. The selected tone signals control currents which are passed by the keyers to the organ output circuitry under the action of the envelope generators, which are individually connected to the keyer groups, and which are activated according to a pattern selected from a plurality of patterns stored in a read only memory. Thus, each note in the chord is treated independently and can be altered and keyed in a different manner from the other notes in the chord.

This feature provides the means for producing a variety of effects such as chord strumming, time variable blending of notes wherein each note is played with a different attack and decay characteristic thereby producing the sound of an ensemble of different percussive instruments blending with non-percussive instruments, and a blending syncopation of notes in a chord.

Since the tones corresponding to the selected chord are altered by means of control signals to the respective keyers, the pattern generating circuitry according to the present invention can easily be incorporated into existing organ circuitry with minimal modification thereof and without duplication of the circuitry.

Specifically, the present invention contemplates a chord pattern generation system in an electronic organ comprising a source of tone signals, output circuitry including acoustic transducer means, a plurality of keyers each having outputs connected to the output circuitry, keyboard controlled means for simultaneously connecting selected ones of the tone signals respectively to the keyers, a plurality of selectively activated envelope control means individually connected respectively to the keyers for causing the keyers to provide respective tone signals to the output circuitry in respective envelopes having predetermined attack and decay characteristics, a memory in which a plurality of note patterns are stored, means for selecting one of the stored patterns, and means for addressing the memory at a rhythmic rate to activate the envelope control means in accordance with the selected pattern.

The invention also contemplates a method for generating patterns of notes corresponding to notes of a selected chord in an electronic organ including a plurality of keyer means having respective inputs and a keyboard including chord playing keys. The method comprises the steps of providing to the keyer means inputs, each time a chord key is actuated, tones corresponding to the notes of the particular chord assigned to the actuated chord key, selecting a note pattern from a plurality of note patterns stored in a memory, in a cyclically repeating fashion, activating the keyer means to pass currents controlled by the tone signals connected to their inputs according to the selected note pattern at a rhythmic rate and with predetermined analog-generated attack and decay characteristics.

It is an object of the present invention to provide means for generating chord patterns wherein tone signals corresponding to notes of the chord are provided to the inputs of keyers which are activated to provide tone signals to the organ output circuitry under the action of independently controlled envelope generators connected individually to the keyers.

Another object of the present invention is to provide means for generating chord patterns wherein digitally derived notes are altered by analog wave forms which are generated by digitally derived input pulses.

Yet another object of the present invention is to provide means for chord pattern generation wherein each note and chord is treated independently and is capable of being altered in a different manner from the other notes of the chord.

A further object of the present invention is to provide a chord pattern generator which can be easily incorporated into existing organ circuitry without undue modification of existing circuitry.

These and other objects of the present invention will be apparent from the detailed description taken together with the accompanying drawings.

BRIEF DESCRIPTION OF THE DRAWINGS

FIG. 1 is a block diagram of the salient portions of an electronic organ incorporating the chord pattern generator according to the present invention;

FIGS. 3A and 3B are a schematic representation of the chord pattern generator.

DETAILED DESCRIPTION

Figure 2:
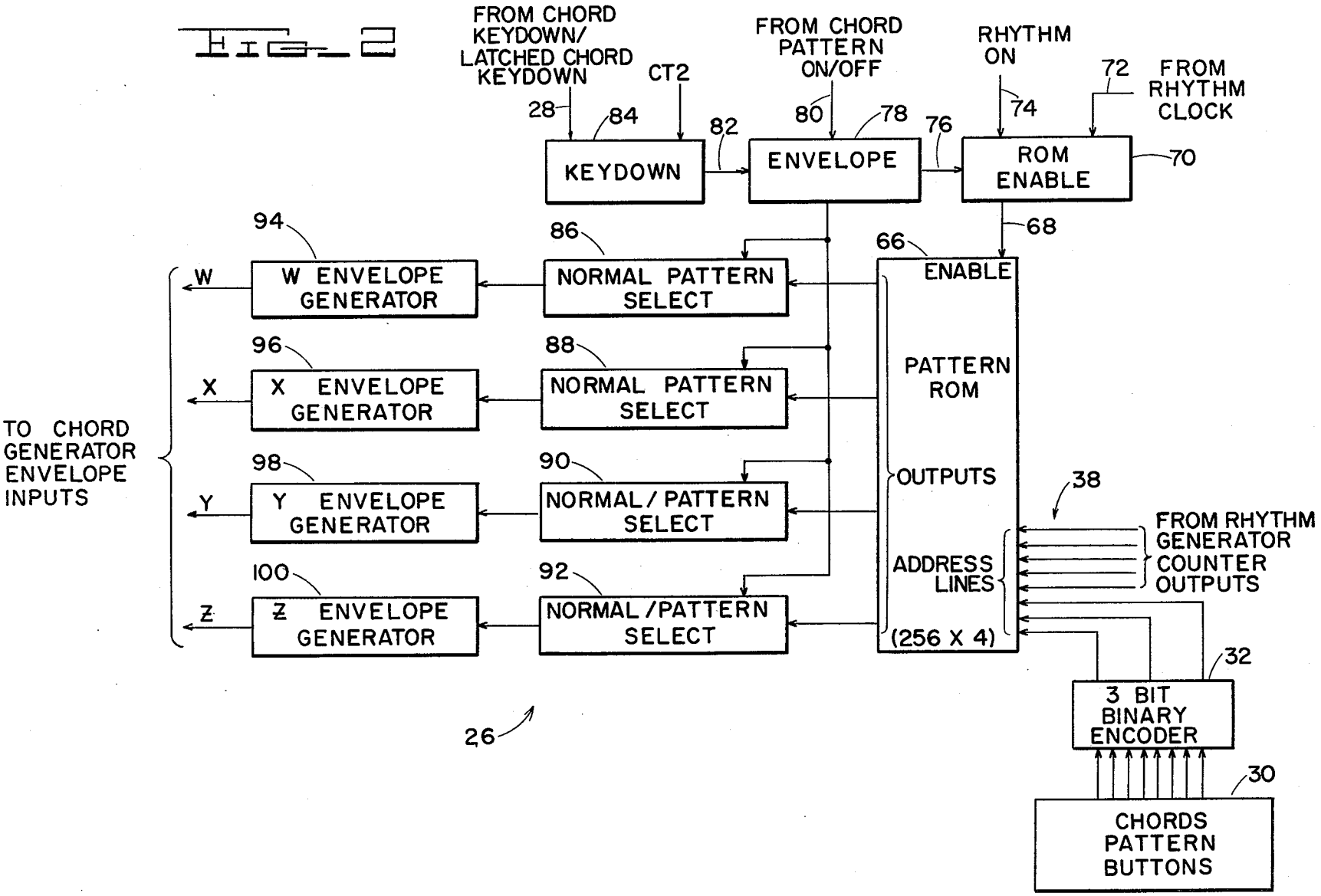
FIG. 2 is a block diagram of the chord pattern generator according to the present invention.

Referring now to the drawings, and in particular to FIG. 1, the system block diagram for an organ incorporating the chord pattern generator of the present invention is shown. The 31 keys of the accompaniment manual 10 are enabled, in the automatic chord mode, to produce signals representative of 31 different chords such A minor, G flat minor, G major, etc. and these signals are encoded in five bit binary encoder 12 and are also fed to two chord keydown module 14 which produces an appropriate signal on line 16 if two of the accompaniment manual keys should be depressed simultaneously in the automatic chord mode.

Binary encoder 12 has a five bit binary output which is fed to the chord generator module 18 over line 20 and also to chord keydown and latch module 22 over line 24. Module 22 is utilized to enable the chord pattern generator 26 over line 28. Chord pattern generator 26 is controlled in part by eight chord pattern buttons 30 which are encoded in three bit binary encoder 32 to select which one of the eight patterns stored in the pattern ROM of chord pattern generator 26 will be selected. Also controlling chord pattern generator 26 is rhythm generator 34 and rhythm clock 36, the former providing a five bit count over lines 38 and the latter a rhythm frequency clock pulse train over line 40. The other control lines for chord pattern generator 26 are the rhythm on/off line 42 from organ control logic module 44, the chord patterns on/off line 46, and the CT2 or "chords on" line 48. The switches controlling organ control logic module 44 are the chord on/off switch 50, the musical rhythm on/off switch 52, the memory rhythm on/off switch 54 and the rhythm on/-off switch 56.

Four envelope outputs from chord pattern generator 26 are fed to chord generator 18 over four lines 58 so as to control the four tones produced by the chord generator for the selected chord. Also feeding chord generator 18 are the 12 top octave tones from tone generator 60. The outputs of chord generator chip 18 are fed to voicing circuits 62 and 64, in the case of two separate voicing channels, and from there to preamp 66 and the output amplifier and speaker 68.

Chord pattern generator 26 is shown in greater detail in FIG. 2 and comprises a 256 by 4 pattern ROM 66 having eight address lines, five of which are the counter outputs from rhythm generator 34 and the other three from the three bit binary encoder 32. The other input to ROM 66 is chip enable line 68 from ROM enable block 70. ROM enable block 70 combines inputs from rhythm clock 36 over line 72, the rhythm on line 74 from switch 56 and an envelope enable line 76 from envelope enable block 78 which in turn is controlled by the chord patterns on/off line 80 and line 82 from keydown circuit 84. Circuit 84 is fed by the CT2 line and line 28 from chord keydown/latched chord keydown circuit 22.

In addition to controlling pattern ROM 66 through ROM enable block 70, envelope enable block 78 controls the normal/pattern select blocks 86, 88, 90 and 92 at the inputs to envelope generators 94, 96, 98 and 100. Select blocks 86, 88, 90 and 92 each determine whether chord patterns or normal straight chords will be played when the chord keys of the accompaniment manual 10 are depressed. The W, X, Y and Z outputs from envelope generators 94, 96, 98 and 100 control the keying and attack and decay characteristics of the four notes in a four note chord produced by chord generator 18.

Figure 4A:
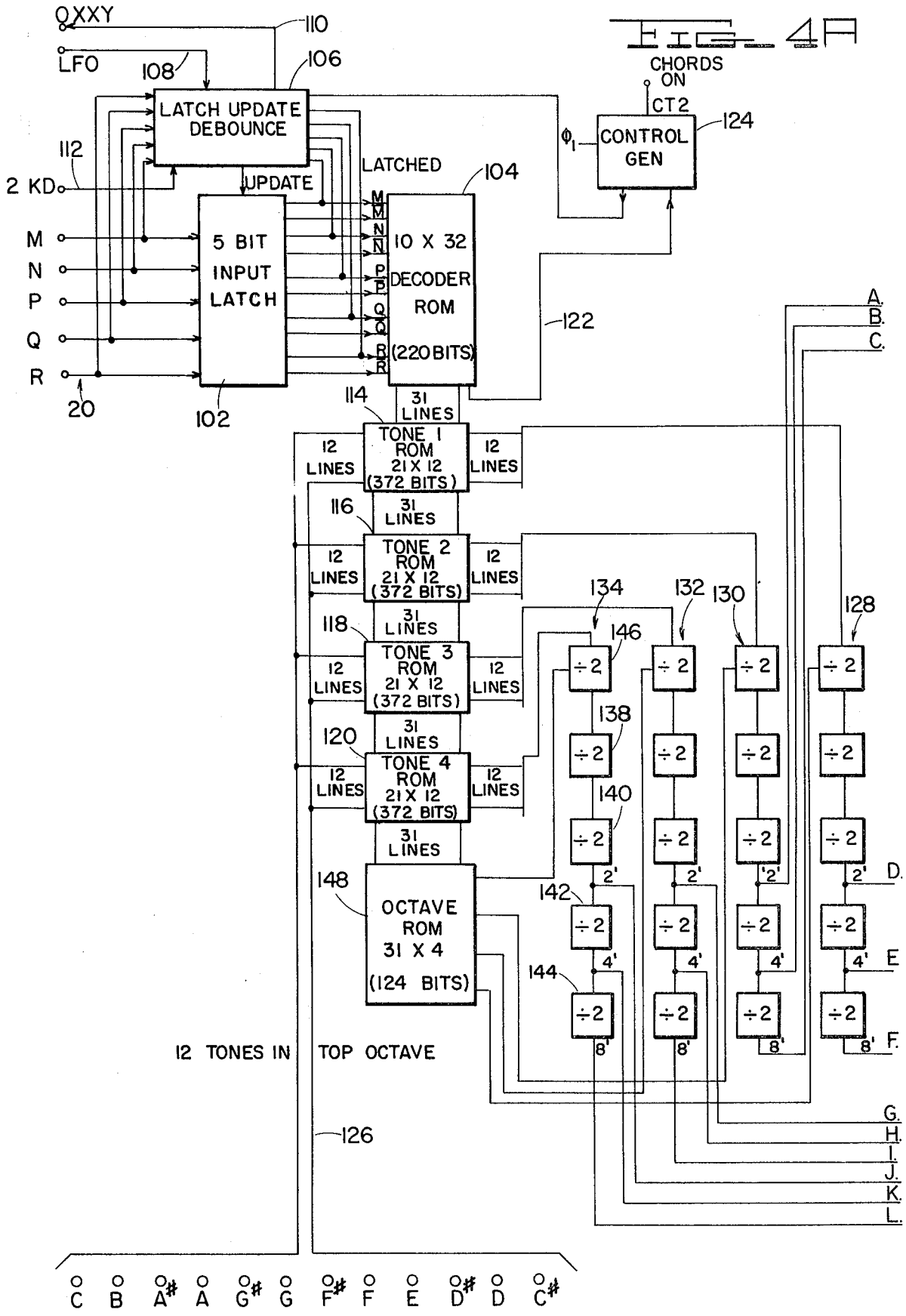
FIGS. 4A and 4B are a schematic representation of the chord generator of the organ shown in FIG. 1.
Figure 4B:
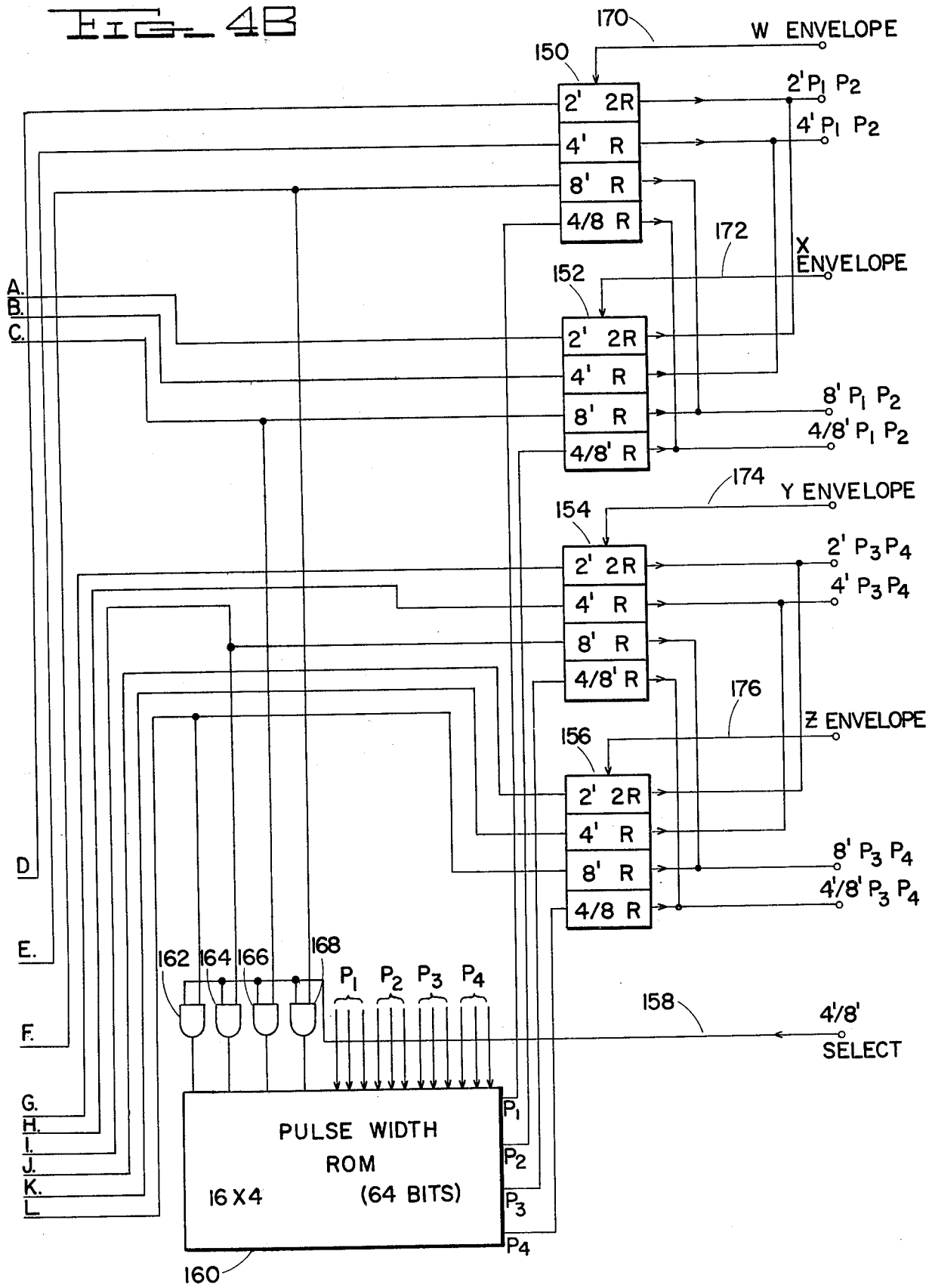

Prior to discussing the chord pattern generator in further detail, chord generator 18 will be explained with reference to FIGS. 4A and 4B. Basically, the system shown in FIGS. 4A and 4B receives a five bit binary chord word, provides for debouncing and utilizes it to generate four note chords. Each component of the chord has its own keyer bank and its own envelope control and some of the output pitches which can be provided include eight foot square waves, four foot square waves, two foot square waves with a 2R keyer (one-half the amplitude), and a four foot/eight foot selectable pulse.

The input lines to the system include a five bit binary word over the lines labeled M, N, P, Q and R which are represented as lines 20 leading from the five bit binary encoder 12 in FIG. 1. The 31 different chords which can be selected by depressing the respective 31 keys in the accompaniment manual 10 are represented by 31 five bit binary words, with the thirty-second state of encoder 12 representing no chord playing key being depressed. Lines 20 are connected to latch 102 which in turn drives decoder ROM 104 which is a 10 by 32 ROM, with 10 input lines M, $\overline{M}$ through R, $\overline{R}$. Latch 102 and latch update/debounce circuit 106 together comprise a binary debouncer described in copending Application Ser. No. 738,754 filed Nov. 4, 1976, now U.S. Pat. No. 117,758, and prevents acceptance by the chord generator of a false binary word from the accompaniment manual encoder 12. Latch update/debounce circuit 106 is fed from a low frequency oscillator over line 108 and additionally produces an OXXY signal on line 110. If two of the keys in the accompaniment manual 10 are depressed simultaneously, an appropriate signal will be present on 2KD line 112.

Decoder ROM 104 has 32 output lines, 31 of which feed tone ROMS 114, 116, 118 and 120 whereas the thirty-second line 122 provides a "no chord key pressed" signal to control generator 124. Each of tone ROMS 114, 116, 118 and 120 is associated with the appropriate note component of the chord which is selected comprising the fundamental, musical third or minor third, musical fifth or flatted fifth in the case of diminished chords, and the octave of the fundamental or seventh, in the case of seventh chords. Each of ROMS 114–120 are fed over lines 126 by twelve tones of the appropriate pitches for the top octave of the keyboard. The twelve output lines from the tone ROMS 114–120 are collected and fed to divider banks 128, 130, 132 and 134, respectively. Divider banks 128–134 are identical and comprise four divide-by-two dividers 138, 140, 142 and 144 and one selectable divide-by-two divider 146, the latter being controlled by octave ROM 148. Octave ROM 148, which is driven by the 31 lines from decoder ROM 104, enables placing any tone within a 24 note range so that the chord octave can be selected anywhere that it is desired. Each divider chain 128, 130, 132 and 134 comprises the dividers necessary to divide from the 8,000 to 4,000 cycle range down to the appropriate accompaniment frequency.

The outputs of these dividers are then fed to the appropriate keyer banks 150, 152, 154 and 156 each of which comprises four keyers for the two foot, four foot, eight foot and four foot/eight foot pitches. Keyers 150–156 may be of the type disclosed in U.S. Pat. No. 3,389,211, for example. This enables a four foot staircase wave form to be easily generated which, by appropriate mixing, can be converted into an eight foot staircase. It should be noted, that these are accompaniment pitches as opposed to pitches on the solo manual. The four foot/eight foot pitch is a selectable pulse which is either at eight foot or four foot depending on the state of the 4′/8′ select line 158. This pulse is generated in ROM 160 using standard techniques for generating pulses and is fed from the appropriate divider outputs and the appropriate pulse is selected. This is a read only memory and the pulse can be selected so as to be 25%, 12½%, 6¼% or 3⅛%. ROM 160 is essentially four multiple input OR gates each of which has four inputs: the fundamental frequency, twice the fundamental, four times the fundamental and eight times the fundamental, respectively. As the higher frequencies are combined with the fundamental, the pulse width will become narrower. If the fundamental is deleted, the pulse will occur at twice the rate and thus raise the pitch an octave to the four foot level. To enable either the four foot or eight foot pulses to be selected, the lowest frequencies are fed into ROM 160 through selectable AND gates 162, 164, 166 and 168 under the control of 4'/8' select line 158.

The control signals for keyers 150, 152, 154 and 156 are provided over envelope control lines 170, 172, 174 and 176, respectively. The signals on these lines are in the form of envelopes having predetermined attack and decay characteristics and are generated in the envelope generators shown in FIG. 3A. Generally speaking, the control signals on lines 170–176 cause keyers 150–156 to control tone signals corresponding to the frequencies at their inputs with an amplitude essentially proportional to the envelope voltage which in this case gives a rapidly increasing amplitude to the steady state value when the key is depressed and with a more gradual roll-off when the key is released.

Figure 3B:
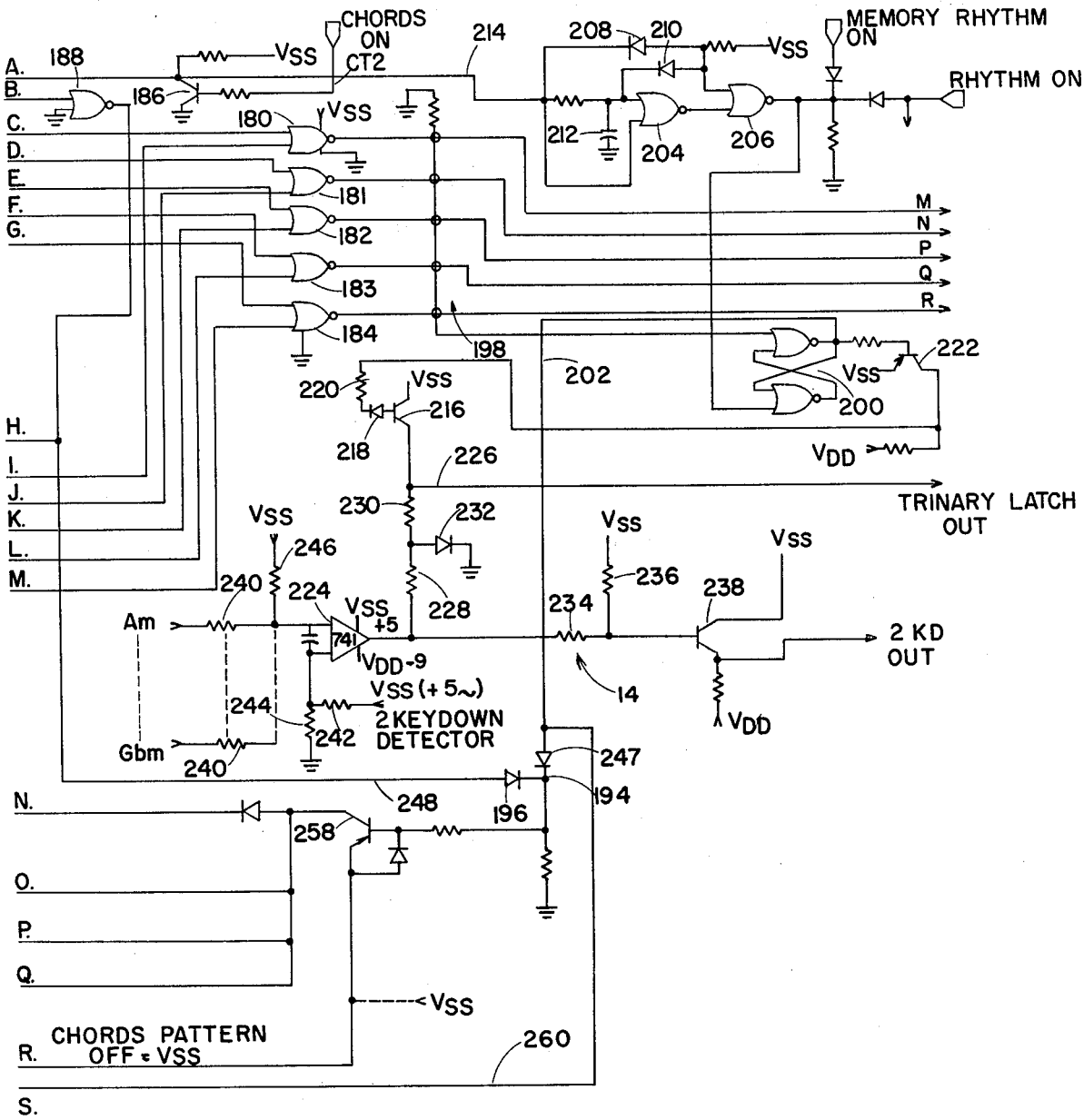

Referring now to FIGS. 3A and 3B, the accompaniment chord key encoder 12 and the pedal encoder 178, which are programmed for five bit binary words, are enabled at gates 180, 181, 182, 183 and 184. With an ON signal on the CT2 line, transistor 186 and gate 188 act to place a disabling signal on line 190 thereby disabling pedal encoder 178 and to place an enabling signal on line 192 thereby enabling the chord key encoder 12. In the opposite state of the CT2 line, pedal encoder 178 is enabled whereas chord key encoder 12 is disabled. The output from gate 188 is also connected to junction point 194 through diode 196. The outputs of gates 180–184 form the M, N, P, Q and R chord words for the chord generator shown in FIGS. 4A and 4B.

Address detector ROM 198 on the outputs of gates 180–184 is utilized for the keydown/latched keydown circuit to latch in RS flip flop 200. This latch comprises the latched information that either a pedal was depressed or, if the CT2 line is activated, that an accompaniment chord key was pressed. If the memory rhythm switch 54 is on, flip flop 200 latches and holds the keydown or pedal down information even though the key or pedal is released. If the memory rhythm switch 54 is off, flip flop 200 functions as a gate allowing the keydown or pedal down line 202 to be activated whenever a key or pedal is held down. Flip flop 200 is reset each time there is a transition on the CT2 line indicating that automatic chords have been switched on or off. This is accomplished by the pulsing circuit comprising NOR gates 204 and 206, diodes 208 and 210 and capacitor 212. This circuit is triggered by a wave form change in either direction on line 214.

Two keydown detector circuit 14 comprises transistor 216 having a diode 218 connected to its base and through resistor 220 to the collector of transistor 222, a comparator op amp 224 with its output connected to line 226 through resistors 228 and 230, a diode 232 connected between the junction of resistors 228 and 230 and ground, a voltage divider including resistors 234 and 236 and a transistor 238. On the input side of op amp 224 are 6.8 K resistors 240 connected to the accompaniment keyboard key switches, a 6.8 K resistor 242, a 2.2 K resistor 244 and a 150 K resistor 246. If two more keys are depressed, comparator op amp 224 senses a voltage imbalance and swings to VSS (+5 v) thereby allowing transistor 238 to cut off to VDD (−9 v). The output of the two keydown detector circuit 14 and latch 200 are combined to form a trinary output for any other type of external operation.

The keydown signal on line 202 is combined through diode 247 with the "chords on" signal on line 248 through diode 196 to enable envelope generators 250, 252, 254 and 256 through transistor 258. In the pattern chord mode, the keydown signal over line 260 is combined at junction point 262 with the 10 millisecond rhythm clock pulse on line 264, the rhythm ON signal on line 266 and the chords pattern on signal on line 268. The 10 millisecond pulse on line 264 is obtained from pulse stretching circuit 270 includes gates 272 and 274. The "chords pattern on" signal on line 276 enables envelope generators 250, 252, 254 and 256 through transistor 258. By these means, a 10 millisecond pulse is applied to the chip enable input 278 of chord pattern ROM 280 each rhythm clock pulse.

This pulse is in synchronism with the rhythm generator counter outputs 38 which provide a five bit binary word (which may be different) for each of the 32 counts forming the rhythm cycle. Chord patterns ROM 280 has the storage capability for eight patterns, for example, one of which is selected by an appropriate three bit binary word on lines 282 from three bit binary encoder 32 which encodes chords pattern buttons 30. The output of chord patterns ROM 280 is in the form of pulse trains at outputs B1, B2, B3 and B4 which are fed to envelope generators 256, 254, 252 and 250 over lines 284, 286, 288 and 290, respectively. For each rhythm interval, one or more of the envelope generators 250–256 may receive an input from chord patterns ROM 280, so the thirty-two note (or sixteen note) pattern is not restricted to a sequence of monophonic tones. By expanding ROM 280, a larger number of patterns could be realized.

Envelope generators 250–256 apply time varying analog-type wave forms to the envelope inputs 170, 172, 174 and 176 of the chord generator 18 in response to input voltage levels on lines 282, 284, 286 and 290. The current out is grossly proportional to the amount of voltage on the inputs so that for zero voltage, there is no output on lines 170–176 and at −17 volts, full output voltage is present on lines 170–176. In between these limits, the keyer is substantially linear. The envelope generator applies a wave shape which has a fast attack and certain amount of decay so as to generate a sound similar to a plucked or struck instrument such as a piano or guitar.

Since envelope generators 250, 252, 254 and 256 are essentially identical, only generator 250 will be described in detail. It comprises an input switching transistor 292 and its associated resistors 294, 296 and 298 which is fed from VSS (+5 v.) on its emitter and VGG (−17 v.) on its collector. In its on state, it is saturated and capacitor 300 is at zero volts, thus there is no output from the associated keyer 150. When transistor 292 suddenly becomes cutoff by the output from chords patterns ROM 280 over line 290, capacitor 300 charges through diode 302, resistor 304 and resistor 306. Since resistor 306, which is 1.2 M, is so much larger than the 10 K resistor 304, the charge path is essentially through resistor 304 which gives a moderate attack. As long as the width of the pulse out of ROM 280 is longer than the attack time, capacitor 300 will charge up to full supply voltage. When this occurs, the envelope reaches full supply voltage and operates to turn the keyer currents on to the maximum.

When the pulse on line 290 goes to zero, transistor 292 again becomes conducting thereby enabling capacitor 300 to discharge primarily through resistor 306. This produces a moderately long sustain by allowing the envelope to decay out more gradually. Since the periods of the pulses used by ROM 280 are on for a short period of time and off for a long period of time, the envelope will decay out completely.

An optional feature of envelope generators 250–256 is a snub system which allows a variation in in the decay of the envelope. Normally, the envelope decay produced by the circuitry described above would be exponential in nature. In some cases, however, it is desirable to have a decay with a double slope to produce a percussive sound imitative of instruments such as a piano or banjo. To achieve this, a snub circuit is utilized which allows a more rapid decay during the first part of the discharge cycle which tapers off to a much longer decay.

This is accomplished by diode 308, 1.2 K resistor 310, 560 ohms resistor 312 and the 1.2 K resistor 314. When the voltage at the cathode of diode 308 is more negative than that produced by the voltage divider formed by resistors 312 and 314, diode 308 will be conductive. Therefore, the 39 K resistor 310 will be in the discharge path paralleling resistor 314. When the voltage falls below the voltage divider level, however, diode 308 will become nonconductive thereby forming an open circuit between resistors 310 and 312 so that the only resistor in the discharge path is resistor 314. This results in a relatively fast decay.

The overall circuit operates in the following manner. Depending on which one of the keys of accompaniment manual 10 is depressed, a five bit binary word unique to the chord associated with that key will be provided on the outputs of gates 180, 181, 182, 183 and 184 and a keydown signal will appear on line 202. The five bit chord word is fed into chord generator 18, debounced by circuits 102 and 106 and decoded by ROM 104. The four tones for the four components of the chord are selected by ROMS 114, 116, 118 and 120 and after appropriate division in divider banks 134, 132, 130 and 128, the proper tones are placed on the inputs of keyers 150, 152, 154 and 156.

If the chord pattern switch is OFF, envelope generators 250, 152, 254 and 256 will be activated simultaneously by the keydown signals on lines 290, 286, 284 and 282, and keyers 150, 152, 154 and 156 will be activated simultaneously to produce tone signals at their outputs corresponding to the tones at their respective inputs and having attack and decay characteristics determined by envelope generators 250, 252, 254 and 256.

If the chord pattern switch is ON and a "chords on" signal appears on the CT2 line, when a key in the accompaniment manual 10 is depressed, chord patterns ROM 280 will produce a series of output pulses at its outputs B1, B2, B3 and B4 in accordance with the pattern selected therefrom by the three bit binary word on lines 282. The output pulses will be in synchronism with the 10 millisecond chip enable pulse on input 278. Thus, selected combinations of envelope generators 250, 252, 254 and 256 will be activated in a sequential pattern by input pulses on lines 282, 284, 286 and 288 so as to activate keyers 156, 154, 152 and 150 in a corresponding pattern. If desired, the attack and decay characteristics of envelope generators 250, 252, 254 and 256 may be individually varied by adjusting resistors 304 and 306. As mentioned previously, separate voicing may be provided for the $P_1P_2$ outputs and the $P_3P_4$ outputs, if desired.

The above system lends itself to expansion. For example, ROM 280 could be increased indefinitely to any size desired so as to create a large program of chords or to increase the number of measures for which a selected pattern would be played. Additionally, a plurality of envelope generators could be provided for each envelope control line so that the attack and decay characteristics could be varied as a function of rhythm count and/or pattern.

The following is a list of values for the circuit elements described previously:

| | |
|---|---|
| All diodes | 540–033 |
| Transistors 186, 216 222 and 238 | 550–027 |
| Transistors 258 and 316 | 550–026 |
| All NOR gates | 14001 (CMOS) |
| C 212 | .001mf |
| C 300 | .047mf |
| R 220 | 180k |
| R 230 | 2.7K |
| R 228 | 3.9K |
| R 234 | 12K |
| R 236 | 1K |
| R 246 | 150K |
| R 240 | 68K |
| R 242 | 68K |
| R 244 | 22K |
| R 298 | 47K |
| R 296 | 33K |
| R 294 | 6.8K |
| R 318 | 4.7K |
| R 304 | 10K |
| R 306 | 1.2M |
| R 312 | 560 ohms |
| R 314 | 1.2K |
| R 310 | 39K |

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the limits of the appended claims.

What is claimed is:

1. A chord pattern generator for an electronic organ comprising:

a source of tone signals of diverse pitches, output circuitry including acoustic transducer means, a plurality of keyers each having outputs connected to said output circuitry, keyboard controlled means for simultaneously connecting selected ones of said tone signals respectively to diverse said keyers such that only one said tone signal is connected to any one of said diverse keyers, at least three selectively activated envelope control means individually connected respectively to said diverse keyers for causing said diverse keyers to key respective said tone signals to said output circuitry in respective envelopes having predetermined attack and decay characteristics, a memory in which a plurality of note patterns are stored, means for selecting one of said stored patterns, and means for addressing said memory at a rhythmic rate to activate said three envelope control means in accordance with the selected pattern.

2. The chord pattern generator of claim 1 wherein said keyboard controlled means includes automatic chord generation means wherein the depression of one key of a predetermined group of keys on a keyboard causes a plurality of tones forming a chord unique to the depressed key to be connected to said keyers.

3. The chord pattern generator of claim 2 wherein:

said automatic chord generation means produces a binary signal unique to the depressed key for selecting the tones which are connected to said keyers, said envelope control means are digitally activated and produce analog envelope signals for determining the attack and decay characteristics of the tone signals passed by said keyers.

4. The chord pattern generator of claim 2 including selection means for selectively disabling said memory and causing all of said envelope generators to be activated simultaneously when one key of said predetermined group of keys is depressed.

5. The chord pattern generator of claim 1 wherein certain of said patterns stored in said memory call for one or more of said envelope control means to be activated at one time so as to effect the playing of chords.

6. The chord pattern generator of claim 1 including means for individually adjusting the attack and decay characteristics of said envelope control means.

7. The chord pattern generator of claim 1 wherein said means for addressing includes rhythm generator means for generating a plurality of cyclically repeating time sequential digital signals at a rhythmic rate, said digital signals being connected to addressing lines of said memory.

8. The pattern chord generator of claim 7 wherein said rhythm generator includes a counter and said digital signals comprise a series of binary words corresponding to respective counts of said counter.

9. The chord pattern generator of claim 1 including a keyboard having chord playing keys and keydown means for enabling said envelope control means to be activated only while one of said chord playing keys is depressed.

10. The chord pattern generator of claim 9 including selectively activated latch means for overriding said keydown means and continuously enabling said envelope control means to be activated until said latch means is reset.

11. In an electronic organ having a source of tone signals of diverse pitches, output circuitry including an acoustic transducer, and a plurality of keyers each having outputs connected to the output circuitry, a method for generating patterns of tones corresponding to notes of a selected chord comprising:

selecting a plurality of said tone signals, simultaneously connecting said selected tone signals respectively to diverse keyers such that only one tone signal is connected to any one of the keyers, storing a plurality of note patterns in a memory, selecting one of the stored note patterns, providing at least three selectively activated envelope generators connected respectively to the keyers, and addressing the memory at a rhythmic rate to activate the three envelope generators in accordance with the selected pattern to cause said keyers to key respective said selected tone signals to said output circuitry in respective envelopes having attack and decay characteristics pertaining to the respective envelope generators connected to the keyers.

12. The method of claim 11 wherein the organ includes a keyboard having a group of chord playing keys and wherein said tone signals are provided to said keyer means on the depression of a selected single one of said chord playing keys.

13. The method of claim 11 wherein said memory is addressed by a cyclically repeating series of binary word counts.

* * * * *